US006545684B1

(12) United States Patent
Dragony et al.

(10) Patent No.: US 6,545,684 B1
(45) Date of Patent: Apr. 8, 2003

(54) ACCESSING DATA STORED IN A MEMORY

(75) Inventors: Joseph M. Dragony, Carmichael, CA (US); Prashant Sethi, Folsom, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/474,120

(22) Filed: Dec. 29, 1999

(51) Int. Cl.[7] ..... G09G 5/39

(52) U.S. Cl. ..... 345/531; 345/559; 345/568; 711/206

(58) Field of Search ..... 345/531, 530, 345/540, 545, 501, 559, 568, 543, 544; 711/147, 149, 150, 170–173, 202–208

(56) References Cited

U.S. PATENT DOCUMENTS 6,072,507 A * 6/2000 Balatsos et al. ..... 345/568
6,247,084 B1 * 6/2001 Apostol et al. ..... 711/147
6,362,826 B1 * 3/2002 Doyle et al. ..... 345/568

OTHER PUBLICATIONS

"Memory Management Support for Tiled Array Organization," Gary Newman, *Computer Architecture News*, vol. 20, No. 4, Sep. 1992, pp 22–30.

* cited by examiner

*Primary Examiner*—Kee M. Tung
(74) *Attorney, Agent, or Firm*—Fish & Richardson P.C.

(57) ABSTRACT

A size of a tile of memory is determined, where a tile is a segment of the memory having a dimension that is less than a pitch of the memory. Data is then stored in the tile. To access the data, a graphics processor obtains an indication (from a configuration register) that the memory is tiled, and accesses the data stored in the tile before accessing other segments of the memory.

30 Claims, 6 Drawing Sheets

ACCESSING DATA STORED IN A MEMORY

BACKGROUND OF THE INVENTION

This invention relates to storing data in a memory and to accessing that data.

Data is accessed from a memory, such as a graphics memory, on a row-by-row basis. Heretofore, this meant that the entire pitch of the memory had to be traversed each time the memory was accessed, regardless of how the data is stored in the memory. For example, referring to FIG. 1, to access data 1, it was necessary to traverse the entire pitch 2 of memory 4, row-by-row (arrows 5), starting with top row 6 and working downward. A large portion of unused memory 7 is thus unnecessarily traversed.

SUMMARY OF THE INVENTION

In general, in one aspect, the invention relates to accessing data stored in a memory. This aspect of the invention features obtaining an indication that the memory is tiled, where a tile comprises a segment of the memory having a dimension that is less than a pitch of the memory, and accessing data stored in a target tile of the memory before accessing other segments of the memory.

Among the advantages of this aspect of the invention may be one or more of the following. Accessing data in a tiled memory reduces the need to traverse unused portions of memory, thus reducing the amount of time it takes to read data from the memory. Also, use of a tiled memory can reduce the amount of unused (wasted) memory, particularly if the tiles are based on the memory's page size.

Other features and advantages of the invention will become apparent from the following description and drawings.

DESCRIPTION

Figure 2:
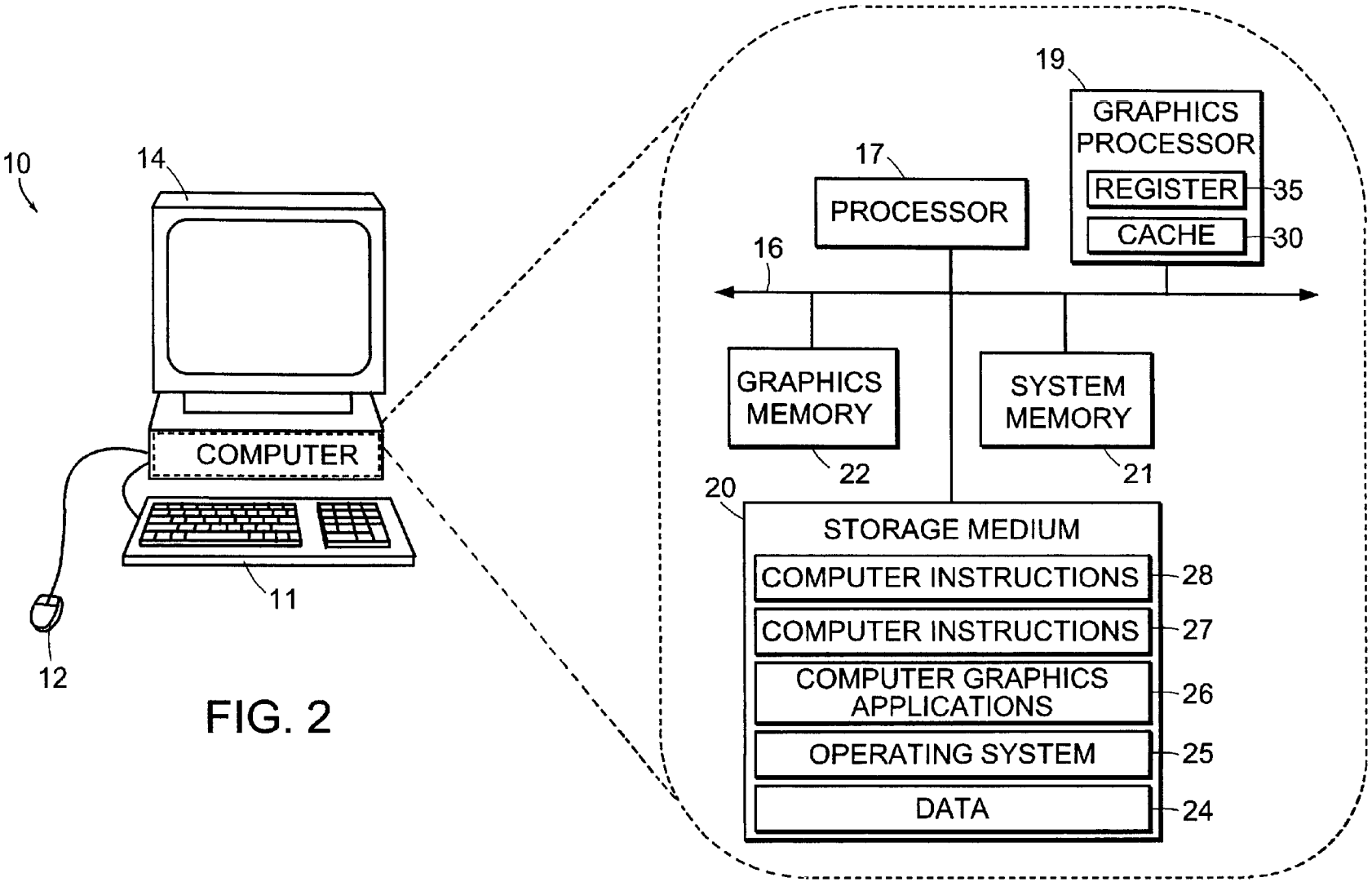
FIG. 2 is a view of a computer system on which one embodiment of the invention may be implemented.

In FIG. 2, a computer 10 is shown on which an embodiment of the invention is implemented. Computer 10 includes input devices, such as keyboard 11 and mouse 12, and a display screen 14. Internal components of computer 10 are shown in view 15. These include one or more buses 16, processor 17, graphics processor 19, storage medium 20, operating system memory 21, such as a RAM ("Random Access Memory"), and graphics memory 22.

Storage medium 20 is a computer hard disk or other memory device that stores data 24, an operating system 25, such as Microsoft® Windows98®, computer graphics applications 26, and computer-executable instructions 27 and 28 for allocating, configuring and accessing memory. Graphics processor 19 is a microprocessor or other device that may reside on a graphics accelerator card (not shown). Graphics processor 19 executes graphics applications 26 to produce imagery, including video, based on data 24.

During operation, graphics processor 19 requires memory to process data 24 and to generate images based on that data. In this embodiment, graphics memory 22 and/or portions of system memory 21 are used by graphics processor 19 for these purposes. Data is stored in, and accessed from, segments of memory called "tiles".

Figure 1:
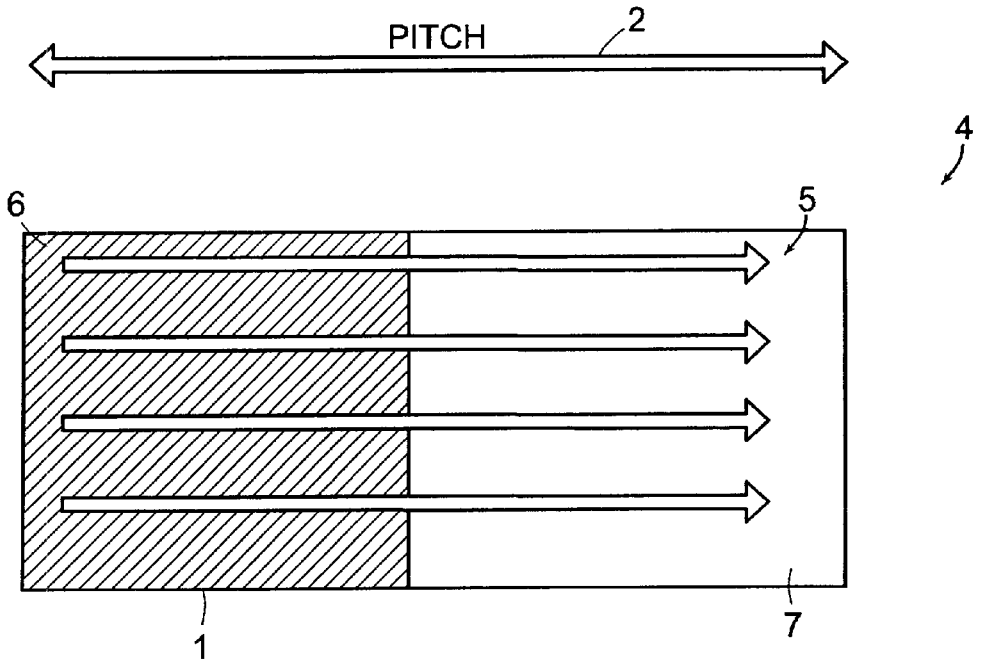
FIG. 1 PRIOR ART
FIG. 1 is a view of a memory which stores data according to the prior art.
Figure 3:
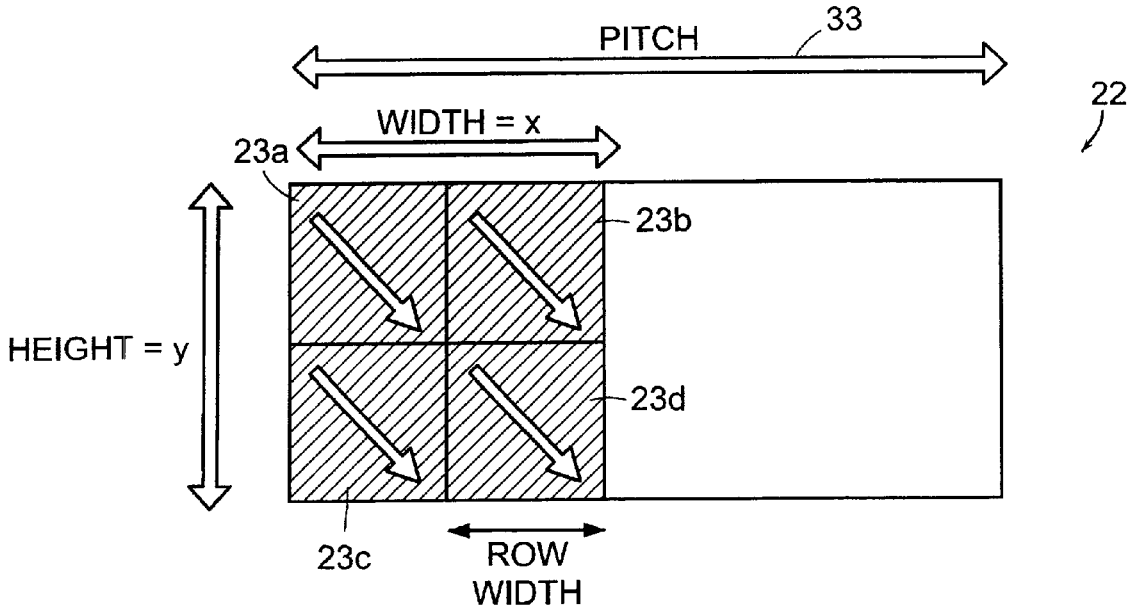
FIG. 3 is a view of a tiled memory.

In this context, a tile is any segment of memory having a dimension (such as a row width or column height) that is less than a pitch (total width or height) of the memory. For example, FIG. 3 shows graphics memory 22 partitioned into tiles 23*a*, 23*b*, 23*c* and 23*d*, each of which has a row width that is less than a pitch 33 of the memory.

Figure 4:
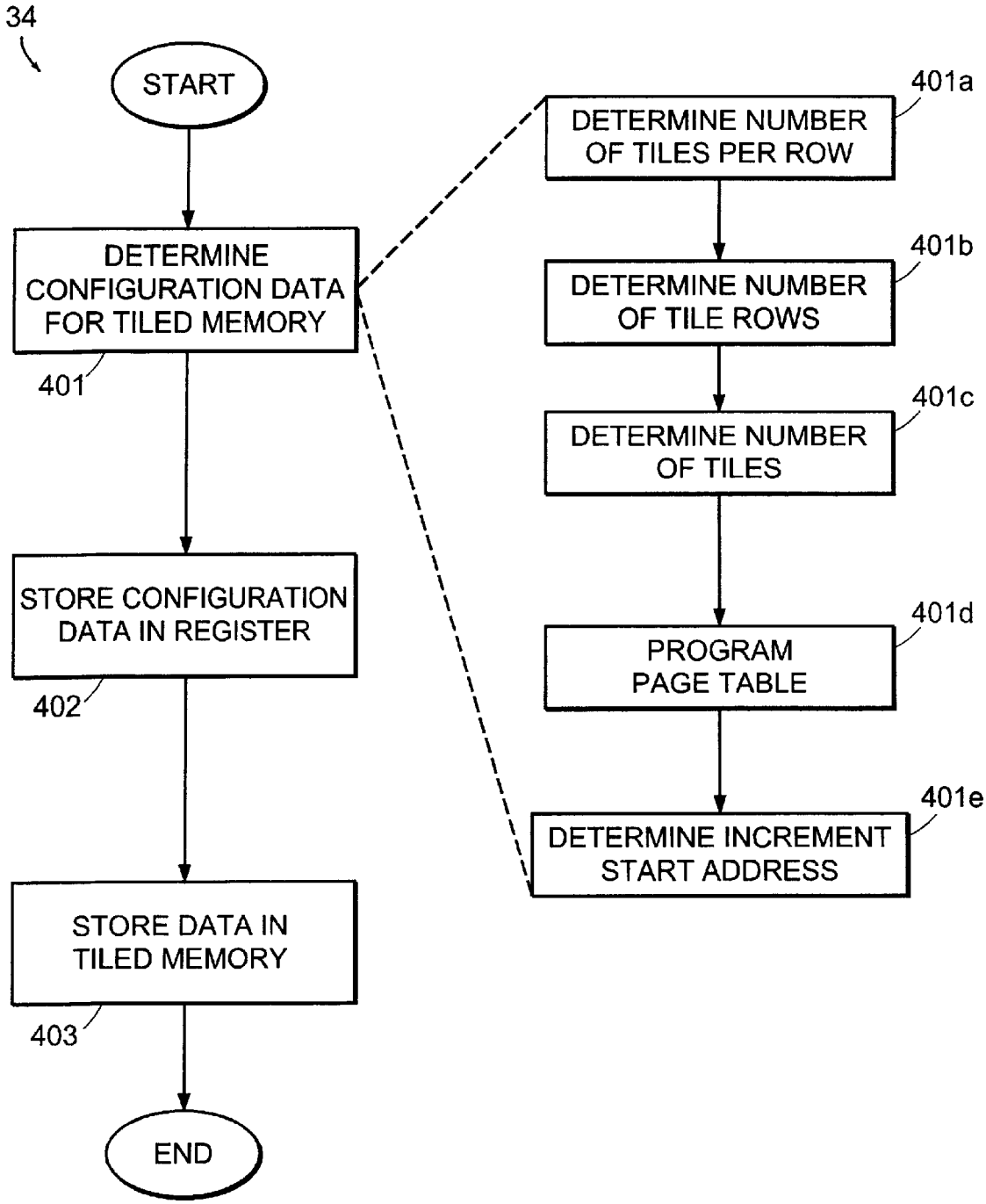
FIG. 4 is a flowchart showing a process for determining configuration data for a tiled memory.

FIG. 4 shows a process 34, which is implemented by computer instructions 27 executing on processor 17, for configuring tiles in a memory and for storing data in those tiles. Process 34 begins by determining (401) configuration data for the memory (or some portion thereof). As described below, the memory may be graphics memory 22, system memory 21, and/or some other memory. For the sake of simplicity, the description will refer to graphics memory 22 only.

Configuring graphics memory 22 (or a portion thereof) as a tiled memory entails determining (401*a*) the number of tiles needed per row of memory, determining (401*b*) the number of tile rows needed, and determining (401*c*) the total number of tiles needed. Assuming that the portion of graphics memory to be tiled has a width of "x" bytes and a height of "y" rows (FIG. 3), and that the tile size (width and height) is known beforehand, this is done as follows.

The number of tiles per row is equal to width "x" (rounded up to the nearest integral multiple of the tile width, if necessary) divided by the individual tile width. For example, if the tile width is 128 bytes, and if the portion of graphics memory 22 to be tiled has a width "x" of 512 bytes, the number of tiles per row is $$\frac{512 \text{ bytes}}{128 \text{ bytes}} = 4.$$

The number of tile rows is equal to height "y" (rounded up to the nearest integral multiple of the tile height, if necessary) divided by the tile height. For example, if the tile height is 16 lines and if the portion of graphics memory 22 to be tiled has a height "y" of 64 lines, the number of tiles rows is $$\frac{64 \text{ lines}}{16 \text{ lines}} = 4.$$

The total number of tiles is determined as follows. The number of tiles per row is multiplied by the tile size. The resulting product is rounded up to the nearest multiple of the memory page size (if necessary) (see below) and divided by the tile size. The quotient is then multiplied by the number of tile rows. For the example given above, if the tile size is 2048 bytes (16 lines×512 bytes) and the memory page size of graphics memory 22 is 4096 bytes, the total number of tiles is $$\frac{4 \text{ tiles per row} \times 2048 \text{ bytes}}{2048 \text{ bytes}} \times 4 \text{ tile rows} = 16 \text{ tiles.}$$

The memory page size corresponds to a segment of memory which stores a block of data, such as an image, to be processed and displayed. Tiles are aligned to page boundaries in the memory, which simplifies access to, and storage of, data. A page table (stored in an internal memory (cache) 30 of graphics processor 19) is used to allocate pages of memory to be tiled. Process 34 programs (401*d*) the page table to allocate the appropriate number of pages of memory. The appropriate number of pages per row is determined as follows $$\frac{\frac{\text{number of tiles}}{\text{number of tile rows}} \times \text{tile size}}{\text{page size}}.$$

For the example given above, the number of pages per row is $$\frac{\frac{16}{4} \times 2048}{4096} = 2 \text{ pages per row.}$$

Thus, in this example, process 34 allocates eight pages of memory to sixteen tiles (i.e., two pages per row multiplied by four rows).

After the page table has been programmed, process 34 determines (401*e*) an increment start address for the tiles. The increment start address is the amount by which the byte address of a current row of tiles must be incremented to access a next row of tiles (and is used by graphics processor 19 to access the tiles). The increment start address is determined by multiplying the pitch of graphics memory 19 by the height of an individual tile. Assuming that the pitch of graphics memory 22 is 4096 bytes, in the example given above, the increment start address is $$4096 \text{ bytes} \times 16 = 65535 \text{ bytes.}$$

Pseudo code for implementing 401*a* to 401*e* to obtain the foregoing values is shown in the attached Appendix.

Once configuration data for graphics memory 22 has been determined, process 34 stores (402) the configuration data in a register 35 (FIG. 2) of graphics processor 19. A "fence" register is typically used; however, the configuration data may be stored in other registers as well. The configuration data indicates that graphics memory 22 is tiled, identifies the number of tiles in memory 22, the size(s) of the tiles, and the locations of the tiles (see 401*a* to 401*e*). Thereafter, process 34 stores (403) graphics (or other) data in the tiles based on this configuration data.

Figure 5:
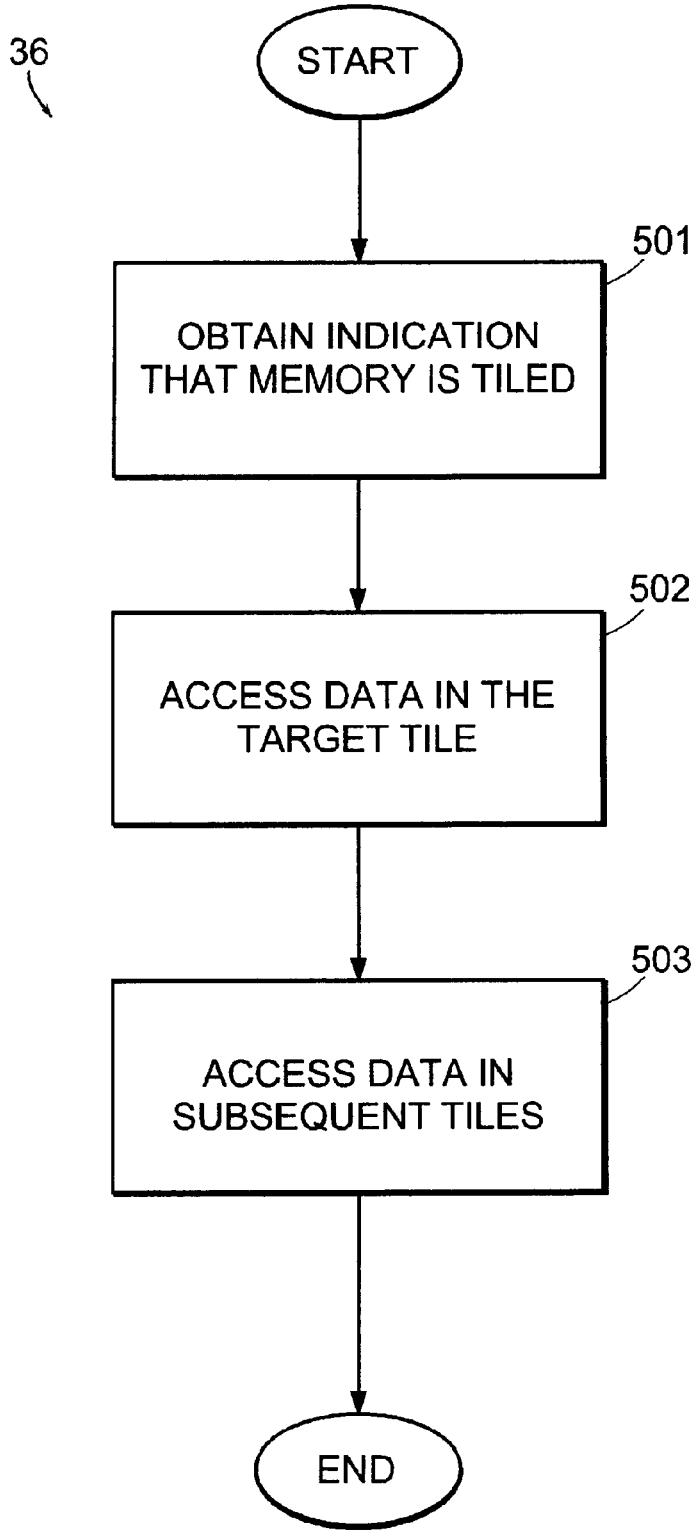
FIG. 5 is a flowchart showing a process for reading data from a tiled memory.

In FIG. 5, a process 36 is shown by which graphics processor 19 reads data from tiled graphics memory 22. This process is implemented via computer instructions 28 executing in graphics processor 19. In process 36, graphics processor 19 obtains (501) an indication that graphics memory 22 is tiled, together with information identifying the size and locations (addresses) of tiles in memory 22. This information is obtained by reading the configuration data from register 35.

Figure 6:
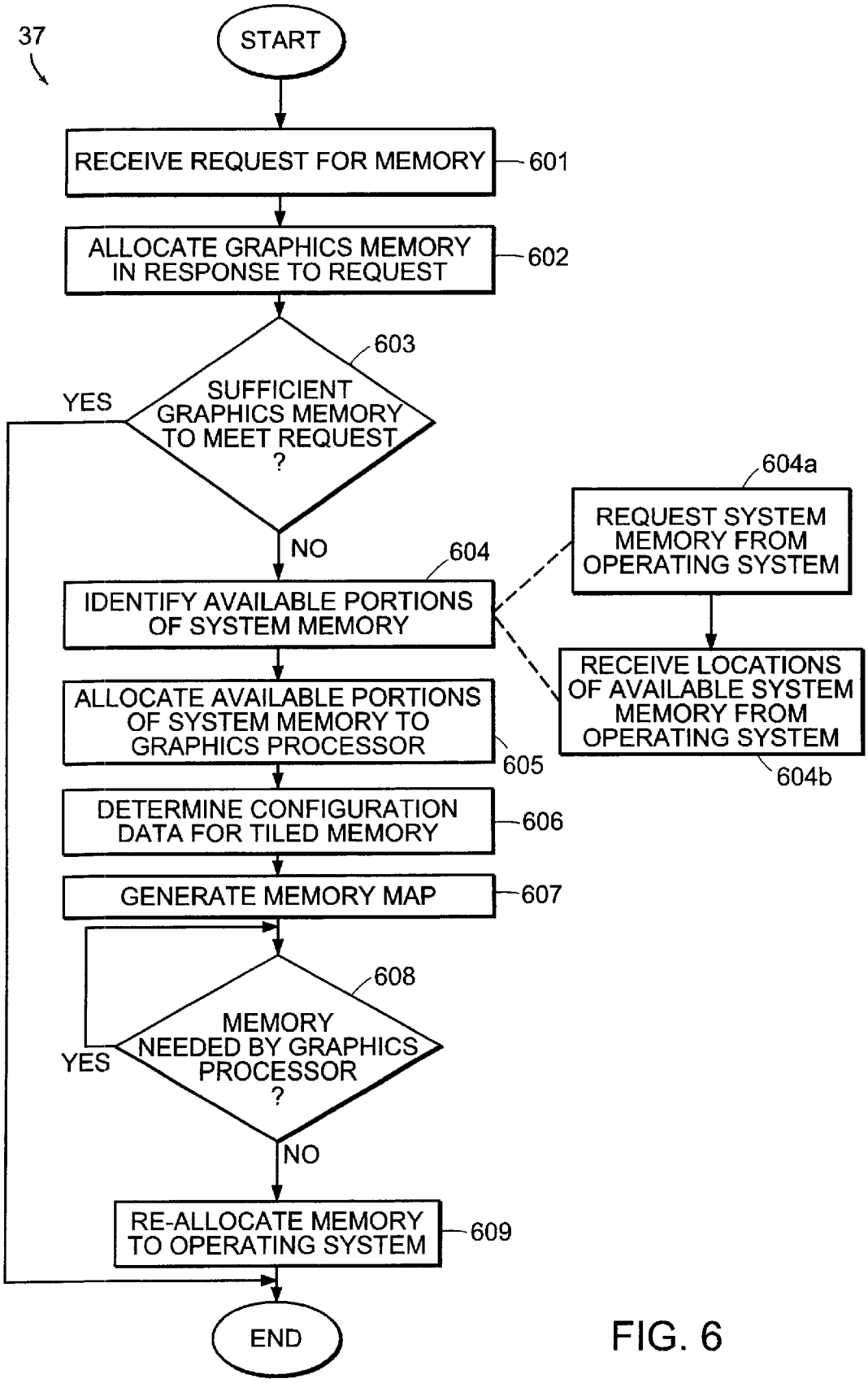
FIG. 6 is a flowchart showing a process for allocating memory to be tiled.

Process 36 then accesses (502) data stored in tiled graphics memory 22. Contiguous tiles may be accessed sequentially. Discontiguous tiles may be accessed via a page table, as described below with respect to process 37 (FIG. 6). In any case, data in a "target" tile is accessed by traversing the tile, row-by-row, until all data stored in the tile has been retrieved. Thus, data is accessed (502) in the "target" tile before data in a subsequent tile(s) is accessed (503). As a result, graphics processor 19 does not need to traverse the entire pitch of graphics memory 22 in order to obtain data from a single tile.

As noted above, tiles may be accessed using a page table (which may be a same or different page table than that noted above). This feature is particularly useful if the tiles are spread out across various regions of memory or across more than one memory.

In this regard, graphics processor 19 accesses memory sequentially and, thus, requires contiguous memory to store graphics data. If there is not enough contiguous memory, a page table may be used to map memory addresses output by graphics processor 19 to tiles at different (discontiguous) addresses of graphics memory 22 or even to (discontiguous) addresses of operating system memory 21. Thus, even though such memory is not physically contiguous, it will appear to be contiguous from the perspective of graphics processor 19.

A process 37 for dynamically allocating such memory to graphics processor 19 is shown in FIG. 6. Process 37 is implemented by instructions 27 running on processor 17. To begin, a driver memory manager (not shown) running on processor 17 makes a determination as to how much memory it will need to execute a particular graphics application 26. Graphics processor 19 then formulates a request for the required amount of memory and forwards that request to processor 17 over bus 16. Process 37 (executing in processor 17) receives (601) the request and, in response, allocates (602) available portions of graphics memory 22 to graphics processor 19.

If the amount of contiguous available memory in graphics memory 22 is sufficient to satisfy the request from graphics processor 19 (603), memory allocation process 37 ends. Thereafter, process 34 (FIG. 4) is executed to configure graphics memory 22 into contiguous tiles and then process 36 (FIG. 5) may be executed to read data from those tiles. If there is not sufficient available contiguous graphics memory (603), process 37 allocates other portions of graphics memory and/or available portions of system memory 21 to make up for the deficit of contiguous graphics memory.

By way of example, process 37 identifies (604) available portions of system memory 21. Process 37 requests (604*a*), and receives (604*b*), the locations of available portions of system memory 21 from operating system 25. System memory 21 is addressable in pages, each of which is 4096 bytes in size (in this embodiment). The locations of available system memory provided by operating system 25 therefore correlate to available pages of memory.

These pages may be contiguous portions of system memory or, alternatively, they may be discontiguous portions of system memory 21. In either case, process 37 allocates (605) the available portions of system memory for use by graphics processor 19. The available portions of memory are then tiled (606) in accordance with process 34 (FIG. 4). Following process 34, process 37 generates (207) a memory map to the tiles of system memory (and to graphics memory 22, if applicable). In this embodiment, the memory map is a page table that is generated by process 37 and programmed into cache 30 of graphics processor 19. The table itself may already exist in cache 30, in which case process 37 reprograms the table.

Figure 7:
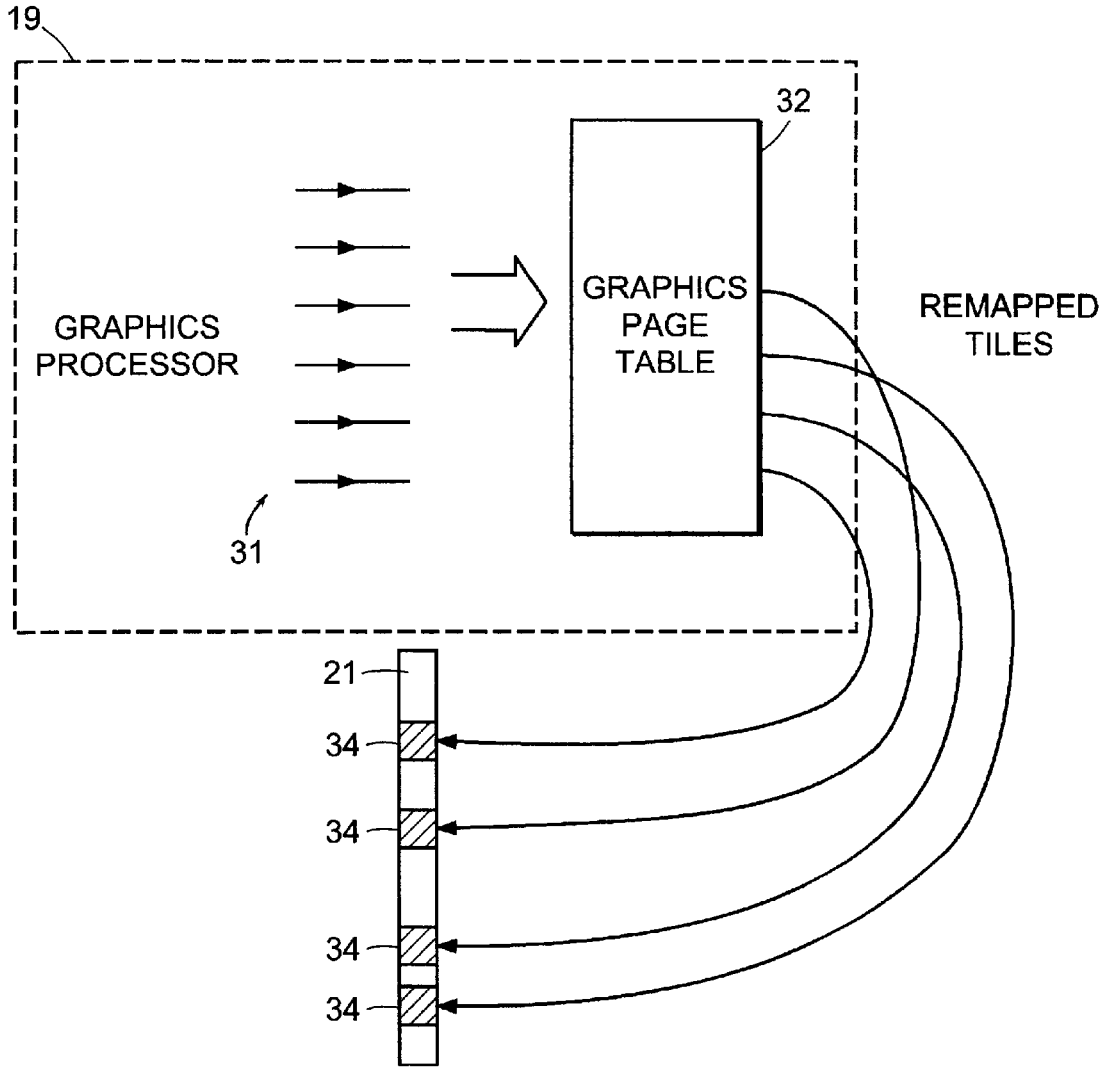
FIG. 7 is a block diagram showing how memory is allocated according to the process of FIG. 6.

The page table maps addresses of physically discontiguous tiles in system memory 21 and graphics memory so that they appear to graphics processor 19 to be a single contiguous memory. This concept is illustrated graphically in FIG. 7. There, graphics processor 19 outputs read/write requests 31 to memory addresses corresponding to contiguous tiles. These requests 31 pass through page table 32, which maps the memory addresses to discontiguous tiles 34 of system memory 21 (and potentially, although not shown, graphics memory 22).

When graphics processor 19 no longer needs the tiled memory (608), it issues an instruction to process 37. Process 37 then re-allocates (609) the system memory (allocated in 605) to operating system 25. This may be done by re-programming the page table in cache 30 so that system memory is no longer available to graphics processor 19. Process 37 also frees used graphics memory by providing unused graphics memory addresses to a "pool" of available addresses. When graphics processor needs additional memory, process 37 is repeated.

Processes 34, 36 and 37 are described with respect to a computer that includes a dedicated graphics memory 22. However, processes 34, 36 and 37 also operate on computers that include no dedicated graphics memory. For example, all memory for graphics processor 19 may be allocated out of system memory 21. In this case, 602 and 603 are omitted from process 37. Similarly, memory may be allocated to graphics processor 19 from other memories (in addition to those shown) and then configured as tiled memory.

Although processes 34, 36 and 37 are described with respect to computer 10, processes 34, 36 and 37 are not limited to use with any particular hardware or software configuration; they may find applicability in any computing or processing environment. Processes 34, 36 and 37 may be implemented in hardware, software, or a combination of the two. Processes 34, 36 and 37 may be implemented in computer programs executing on programmable computers that each include a processor, a storage medium readable by the processor (including volatile and non-volatile memory and/or storage elements), at least one input device, and one or more output devices. Program code may be applied to data entered using an input device to perform processes 34, 36 and 37 and to generate output information. The output information may be applied to one or more output devices, such as display screen 14.

Each such program may be implemented in a high level procedural or object-oriented programming language to communicate with a computer system. However, the programs can be implemented in assembly or machine language. The language may be a compiled or an interpreted language.

Each computer program may be stored on a storage medium or device (e.g., CD-ROM, hard disk, or magnetic diskette) that is readable by a general or special purpose programmable computer for configuring and operating the computer when the storage medium or device is read by the computer to perform processes 34, 36 and 37. Processes 34, 36 and 37 may also be implemented as a computer-readable storage medium, configured with a computer program, where, upon execution, instructions in the computer program cause the computer to operate in accordance with processes 34, 36 and 37.

Other embodiments not described herein are also within the scope of the following claims. For example, the invention can be implemented on computer graphics hardware other than that shown in FIG. 2. The steps shown in Figs. 4, 5 and 6 can be re-ordered where appropriate and one or more of those steps may be executed concurrently or omitted. Processes 34, 36 and 37 may be implemented on a single processor or more than two processors.

What is claimed is:

1. A method of accessing data stored in a memory, comprising:

obtaining an indication that the memory is tiled, where a tile comprises a segment of the memory having a dimension that is less than a pitch of the memory; and accessing data stored in a target tile of the memory using a page table before accessing other discontiguous tiles stored in separate memories.

2. The method of claim 1, further comprising storing configuration data in a register, the configuration data indicating that the memory is tiled;

wherein obtaining the indication comprises reading the configuration data from the register.

3. The method of claim 1, wherein accessing comprises traversing the target tile row-by-row until all data stored in the target tile has been accessed.

4. The method of claim 3, further comprising accessing data in a second tile of the memory after all of the data stored in the target tile has been accessed.

5. The method of claim 1, wherein the target tile comprises a portion of a page of the memory.

6. The method of claim 5, wherein the target tile borders a page boundary of the memory.

7. A method of storing data in a memory, comprising:

determining configuration data for storing data in a tile, the tile comprising a segment of the memory having a dimension that is less than a pitch of the memory;

programming a page table using the configuration information; and storing the data in the tile based on the page table and based on availability of separate graphics memory and system memory.

8. The method of claim 7, wherein the configuration data is based on a page size of the memory.

9. The method of claim 7, wherein the memory comprises the graphics memory.

10. The method of claim 7, wherein the memory comprises an available portion of the system memory; and the method further comprises reading the page table to access the tile in the available portion of system memory.

11. An article comprising a computer-readable medium which stores executable instructions for accessing data stored in a memory, the instructions causing a computer to:

obtain an indication that the memory is tiled, where a tile comprises a segment of the memory having a dimension that is less than a pitch of the memory; and access data stored in a target tile of the memory using a page table before accessing other discontiguous tiles stored in separate memories.

12. The article of claim 11, further comprising instructions that cause the computer to store configuration data in a register, the configuration data indicating that the memory is tiled;

wherein obtaining the indication comprises reading the configuration data from the register.

13. The article of claim 11, wherein accessing comprises traversing the target tile row-by-row until all data stored in the target tile has been accessed.

14. The article of claim 13, further comprising instructions that cause the computer to access data in a second tile of the memory after all of the data stored in the target tile has been accessed.

15. The article of claim 11, wherein the target tile comprises a portion of a page of the memory.

16. The article of claim 15, wherein the target tile borders a page boundary of the memory.

17. An article comprising a computer-readable medium which stores executable instructions for storing data in a memory, the computer instructions causing a computer to:

determine configuration data for storing data in a tile, the tile comprising a segment of the memory having a dimension that is less than a pitch of the memory;

program a page table using the configuration information; and store the data in the tile based on the page table and based on availability of separate graphics memory and system memory.

18. The article of claim 17, wherein the configuration data is based on a page size of the memory.

19. The article of claim 17, wherein the memory comprises the graphics memory.

20. The article of claim 17, wherein the memory comprises an available portion of the system memory; and the article further comprises instructions that cause the computer to read the page table to access the tile in the available portion of system memory.

21. An apparatus for accessing data stored in a memory, comprising:

a storage medium which stores executable instructions; and a processor which executes the instructions to (i) obtain an indication that the memory is tiled, where a tile comprises a segment of the memory having a dimension that is less than a pitch of the memory, and (ii) to access data stored in a target tile of the memory using a page table before accessing other discontiguous tiles stored in separate memories.

22. The apparatus of claim 21, wherein:

the processor executes instructions to store configuration data in a register, the configuration data indicating that the memory is tiled; and the processor obtains the indication by reading the configuration data from the register.

23. The apparatus of claim 21, wherein the processor accesses the memory by traversing the target tile row-by-row until all data stored in the target tile has been accessed.

24. The apparatus of claim 23, wherein the processor accesses data in a second tile of the memory after all of the data stored in the target tile has been accessed.

25. The apparatus of claim 21, wherein the target tile comprises a portion of a page of the memory.

26. The apparatus of claim 25, wherein the target tile borders a page boundary of the memory.

27. An apparatus for storing data in a memory, comprising:

a storage medium which stores executable instructions; and a processor which executes the instructions to (i) determine configuration data for storing data in a tile, the tile comprising a segment of the memory having a dimension that is less than a pitch of the memory, (ii) program a page table using the configuration information, and (iii) store the data in the tile based on the page table and based on availability of separate graphics memory and system memory.

28. The apparatus of claim 27, wherein the configuration data is based on a page size of the memory.

29. The apparatus of claim 27, wherein the memory comprises the graphics memory.

30. The apparatus of claim 27, wherein the memory comprises an available portion of the system memory; and the processor reads the page table to access the tile in the available portion of system memory.

* * * * *